United States Patent [19]

Feklin et al.

[11] Patent Number: 4,484,640

[45] Date of Patent: Nov. 27, 1984

[54] TOOL FOR FORMATION OF HOLES IN MACROPOROUS COMPRESSIBLE SOILS

[75] Inventors: Valentin I. Feklin; Viktor B. Shvets; Boris M. Mazo, all of Dnepropetrovsk, U.S.S.R.

[73] Assignee: Dnepropetrovsky Inzhenerno-Stroitelny Institut, Dnepropetrovsk, U.S.S.R.

[21] Appl. No.: 397,438

[22] Filed: Jul. 12, 1982

[30] Foreign Application Priority Data

Sep. 22, 1981 [SU] U.S.S.R. ..... 3330154

[51] Int. Cl.[3] ..... E21B 7/26

[52] U.S. Cl. ..... 175/19; 175/394; 175/21

[58] Field of Search ..... 175/19, 21, 394

[56] References Cited

U.S. PATENT DOCUMENTS 1,166,153 12/1915 Ridley et al. ..... 175/394
1,639,731 8/1927 Hamiston ..... 175/21

FOREIGN PATENT DOCUMENTS 1162014 8/1969 United Kingdom .
523164 8/1976 U.S.S.R. ..... 175/19

*Primary Examiner*—Stephen J. Novosad
*Assistant Examiner*—Michael Starinsky
*Attorney, Agent, or Firm*—Fleit, Jacobson, Cohn & Price

[57] ABSTRACT

A tool for the formation of holes without extracting the soil comprises a body having a cylindrical calibrating portion, coaxial portions with surfaces for the compaction of the soil and radii decreasing stepwise in the direction away from the calibrating portion, and terminating in an end piece. The body has also transition portions with surfaces for the compaction of the soil, forming a smooth transition from a coaxial portion with a larger radius to an adjacent coaxial portion with a smaller radius. The surface for the compaction of the soil of each coaxial portion is a conical surface having the configuration of a ribbon wound from the calibrating portion to the end piece and comprising the transition portions.

6 Claims, 10 Drawing Figures

TOOL FOR FORMATION OF HOLES IN MACROPOROUS COMPRESSIBLE SOILS

BACKGROUND OF THE INVENTION

1. Field of the Invention

The present invention relates to tools for the formation of boreholes for cast-in-place piles in macroporous compressible soils.

2. Prior Art

The prior application by V. Feklin et al. discloses a tool for the formation of boreholes in macroporous compressible soils, which comprises a body adapted for connection to a drill rod, the body having a cylindrical calibrating portion, coaxial portions, confined by surfaces for the compaction of the soil, with the radii decreasing stepwise from the calibrating portion towards an end piece, and transition portions, defined by surfaces for a compaction of the soil, which form a smooth transition from the surface of a coaxial portion with a larger radius to the surface of an adjacent portion with a smaller radius. The surface for the compaction of the soil of each coaxial portion is a cylindrical surface described by a generatrix of a predetermined length, defined by two cylindrical helical lines having the same helix angle and serving as guides for the generatrix. The soil-compacting surface of each coaxial portion is thus a surface having the configuration of a ribbon wound from the calibrating portion in the adjacent coaxial portion of one radius and so forth in each coaxial portion up to the end piece, the "ribbons" of each coaxial portion being connected by the "ribbons" of the transition portions. In short, although the tool without the calibrating part is cone-shaped, the generatrix of the soil-compacting surface of each coaxial portion and of each transition portion is all the time parallel to the axis of the tool.

Such a construction of the tool makes it possible to form holes with compacted walls, which upgrades the quality characteristics of a hole and prompts increasing the bearing capacity of the cast-inplace piles made in such holes.

However, when such a tool is used to make holes for short cast-in-place piles, the calculated bearing capacity of the piles turns out to be lowered due to that the length of the cone-shaped part of the tool for the formation of short or not very deep holes amounts to 30 . . . 50% and more of their overall length, which reduces the total area of the side surface of cast-in-place piles made in such holes, since the area of the surface of a cone-shaped part with a base of a given diameter is less than the area of the surface of a cylindrical part of the same diameter and the same length or height.

The invention has as its aim to provide an improved tool for the formation of holes in macroporous compressible soils, which, owing to its novel configuration, promotes increasing the bearing capacity of piles, especially of short ones.

SUMMARY OF THE INVENTION

An object of the invention is to provide an improved tool for the formation of holes in macroporous compressible soils, which promotes increasing the bearing capacity of cast-in-place piles.

Another object of the invention is to provide a tool for the formation of holes in macroporous compressible soils, having a soilcompacting surface of such a configuration which promotes increasing the bearing capacity of relatively short cast-in-place piles.

The above-mentioned and other objects of the invention are attained by the provision of a tool for the formation of holes in macroporous compressible soils, which comprises a body adapted for connection to a drill rod, the body having a cylindrical calibrating portion, coaxial portions, defined by surfaces for the compaction of the soil, with the radii decreasing stepwise from the calibrating portion towards an end piece, and transition portions, defined by the surfaces for the compaction of the soil, which form a smooth transition from the surface of a coaxial portion with a larger radius to the surface of the adjacent portion with a smaller radius, wherein, according to the invention, the surface for the compaction of the soil of each coaxial portion is a conical surface described by a generatix of a predetermined length, defined by two conical helical lines having the same helix angle and serving as guides for the generatrix.

Such a tool has surfaces for the compaction of the soil of both the coaxial portions of the body and the transition portions whose generatrix is disposed at an angle to the tool axis, namely at a positive angle if the terminology for a lathe tool might be used. Such a construction allows without extracting the soil to form boreholes whose root portion promotes making a cast-in-place pile with a predetermined bearing capacity over the soil owing to the distribution of forces along the pile surface, so that the vertical component of the load on a pile branches at an angle to the vertical. In this case also the soil surface area taking up the load is increased as against the area in a hole formed by a tool having a cylindrical surface for the compaction of the soil.

To stabilize the movement of the tool in the soil, collars may be provided on the conical surfaces of the coaxial portions of the body and on the surfaces of the transition portions near the shoulders along the helical line. The shoulders may have an extension in the radial direction, which increases coaxially with the portion with a smaller radius, but is not more than the diameter of the calibrating portion. Increasing the extension of the collars facilitates overcoming the additional resistance of the soil, which arises due to the inclination of the generatrix of the surface for the compaction of the soil of the coaxial portions as the tool moves deeper. Also, the coaxial portions may be of either equal or different heights or lengths along the tool axis. The angles of inclination of the generatrix of the surface for the compaction of the soil may be either equal or different for different portions.

BRIEF DESCRIPTION OF THE DRAWINGS

The invention will now be explained by the description of the preferred embodiment thereof with reference to the accompanying drawings, in which.

DETAILED DESCRIPTION OF THE PREFERRED EMBODIMENT OF THE INVENTION

Figure 2:
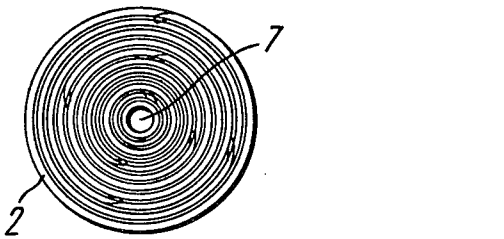
FIG. 2 is a view of the tool when looking on the end piece.
Figure 4:
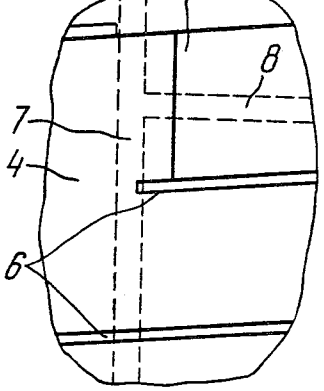
FIG. 4 is a view looking in the direction of the arrow A in FIG. 3.
Figure 3:
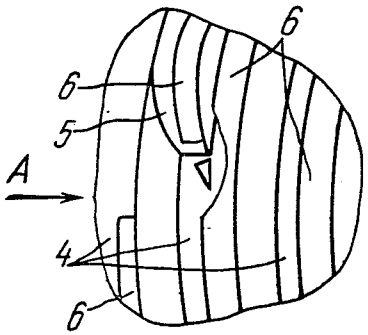
FIG. 3 is an enlarged view of the fragment I in FIG. 2.
Figure 1:
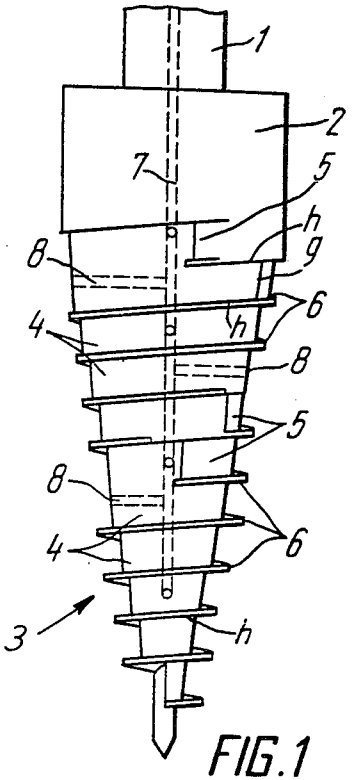
FIG. 1 is a general view of a tool constructed according to the invention.
Figure 8:
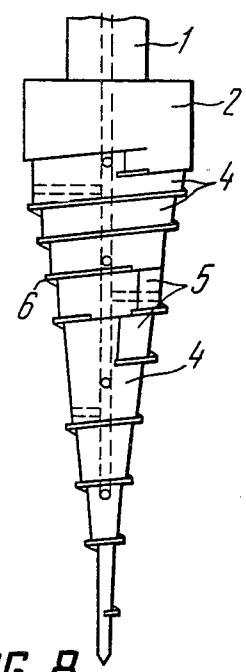
FIG. 8 is a view of a modification of the tool of the invention, having coaxial portions of different length along the axis.
Figure 7:
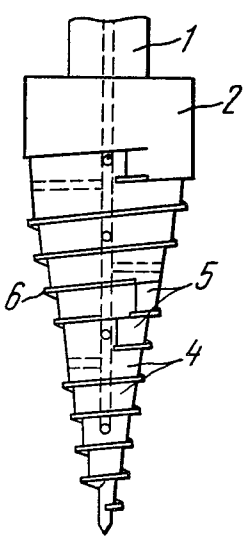
FIG. 7 is a view of a tool, similar to that of FIG. 6, but with the angles of inclination of the generatrix of the surfaces for the compaction of the soil increasing in the top part and decreasing in the bottom part.
Figure 6:
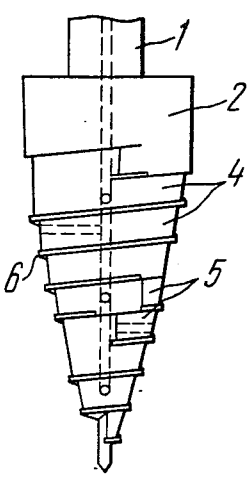
FIG. 6 is a general view of a tool constructed according to the invention, but with sequentially increasing inclination angles of the generatrix of its surfaces for the compaction of the soil.
Figure 5:
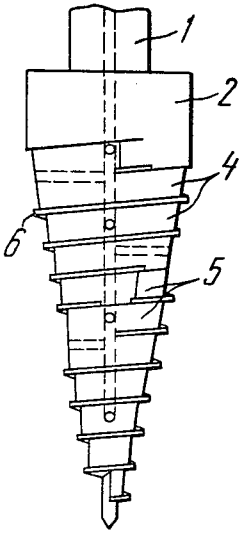
FIG. 5 is a view of a modification of a tool constructed according to the invention, with sequentially decreasing angles of inclination of the generatrices of the surfaces for the compaction of the soil of the coaxial portions to the longitudinal axis of the tool.

Referring to the accompanying drawings, and more exactly to FIGS. 1 through 4, a tool attached to a rod 1 includes a cylindrical calibrating portion 2 and an end piece 3, and coaxial portions 4 each having the configuration of a truncated cone whose larger base is above the smaller one. The coaxial portions 4 are smoothly conjugated with one another by transition portions. Each coaxial portion 4 is defined by a surface for the compaction of the soil, which is a conical surface described by a generatrix g of a predetermined length and defined by two conical helical lines h having the same helix angle and serving as guides for the generatrix. The transition portions 5 have a surface similar to that of the coaxial portions 4, but the guides of its generatrix have a curvature whose radius is smaller than the smallest radius of curvature of the guides of the generatrix of the adjacent overlying coaxial portion; the radius of curvature may be either constant or progressively decreasing. This provides for a stepwise transition from a coaxial portion of a larger radius to a coaxial portion of a smaller radius and at the same time a smooth transition of the surface for the compaction of the soil of one coaxial portion to another. The bottom edges or shoulders of the coaxial portions 4 and of the transition portions 5 are provided with blades or collars 6. Directly above the place of disposition of the transition portions 5 the blades 6 have breaks within ¼ of the length of the circle confining the cross-section of the corresponding portions 4. The width of the blades or the overhang of the collars 6 increases stepwise in the direction from top to bottom for the overlying coaxial portions 4 of the end piece 3. The tool has a passage 7 with branches 8. The passage 7 communicates with a source of liquid (not shown).

The tool function as follows.

When rotation is transmitted to the tool from a drive (not shown) through the rod 1, the tool under action of the axial thrust screws into the soil, pressing it by the surfaces of the transition portions 5 which conjugate the coaxial portions 4 with one another away from the axis of the hole being formed. The collars 6 disposed on the bottom edges of the coaxial portions 4 and of the transition portions 5 promote the stabilization of the tool movement in the soil. The provision of breaks of the collars 6 within ¼ of the length of the circle confining the cross-section of the corresponding portion 4 reduces the required magnitude of the axial thrust. A stepwise increase of the width of the collars 6 in the direction towards the end piece 3 facilitates overcoming the additional resistance of the soil, arising because of an inclination of the generatrix of the surfaces of the coaxial portions 4 to the longitudinal axis. To reduce the forces of friction against the soil in the course of operation, liquid can be fed through the passage 7 and its branches 8 to the places of contact of the surfaces for the compaction of the soil with the soil for producing a lubricating layer. In the course of drilling of the hole, the portion 2 performs the calibrating function.

The use of the tool modifications with different heights of the coaxial portions (FIGS. 5 through 8) and with different angles of inclination of the generatrics of the surfaces of the coaxial portions to the longitudinal axis of the tool allows to distribute in a desired manner the forces over the surface of a future cast-in-place pile made in the hole being formed and to make a pile with predetermined characteristics of the bearing capacity over the soil.

Figure 9:
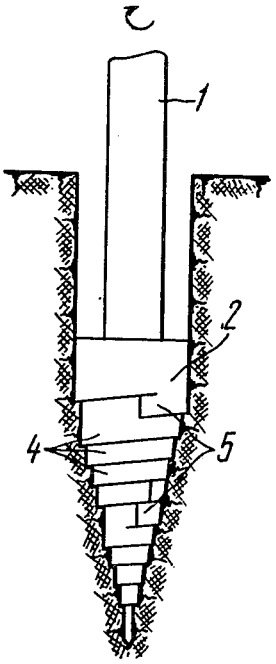
FIG. 9 shows the tool in the course of the formation of a hole.
Figure 10:
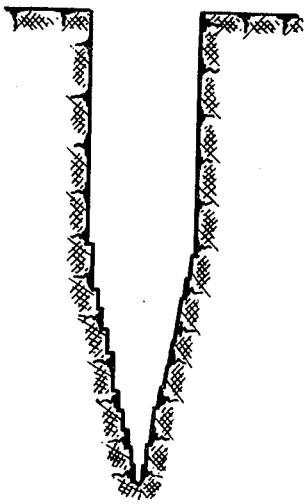
FIG. 10 shows a finished hole.

The use of the proposed tool allows to produce for a short cast-in-place pile a hole (FIGS. 9, 10) whose surface consists of portions having a slope. This makes it possible to increase the bearing capacity of a pile by 10–20% as a result of an additional soil resistance on the side surface.

What is claimed is:

1. A tool for the formation of holes in macroporous compressible soils, said tool comprising:

a body adapted for connection to a drill rod, said body defining a cylindrical calibrating portion to be positioned adjacent to the drill rod, an end piece contiguous with the calibrating portion and extending remote from the drill rod, said end piece comprised of at least two conical coaxial portions interconnected by a transition portion, the radii of said coaxial portions decreasing stepwise from the calibrating portion in a direction towards the free end of said end piece, the stepwise decreasing separating the coaxial portions into a plurality of distinct conical surfaces for the compaction of the soil, each conical surface described by a generatrix of a predetermined length, and defined by two conical helical lines serving as guides for the generatrix, and said transition portion defined by conical surfaces for the compaction of the soil, said transition portion forming a smooth transition of the body surface for the compaction of the soil between the conical surfaces of the coaxial body portion with a larger radius and the conical surfaces of the coaxial portion with a smaller radius.

2. A tool as defined in claim 1, wherein said coaxial portions and said transition portion further comprises blades as part of the bottom edges of the conical surfaces of the coaxial portions of the body and as part of the bottom edges of the surfaces of the transition portion along the helical lines.

3. A tool as defined in claim 1, further comprising a second transition portion position adjacent to said calibrating portion and to one of said coaxial portions.

4. A tool as defined in claim 1, wherein the generatrix of each conical surface for the compaction of the soil of each coaxial portion extends parallel to the axis of the body.

5. A tool as defined in claim 4, wherein some of the conical surfaces of the coaxial portions are of equal heights along the axis of the body.

6. A tool as defined in claim 4, wherein some of the conical surfaces of the coaxial portions are of different heights along the axis of the body.

* * * * *